US010514637B1

(12) United States Patent
Kamata

(10) Patent No.: US 10,514,637 B1
(45) Date of Patent: Dec. 24, 2019

(54) PRINTING APPARATUS AND PRINTING METHOD

(71) Applicant: TOSHIBA TEC KABUSHIKI KAISHA, Shinagawa-ku, Tokyo (JP)

(72) Inventor: Kimie Kamata, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/164,283

(22) Filed: Oct. 18, 2018

(51) Int. Cl.
*G03G 15/20* (2006.01)
*G03G 15/00* (2006.01)
*G03G 15/23* (2006.01)

(52) U.S. Cl.
CPC ..... *G03G 15/2039* (2013.01); *G03G 15/205* (2013.01); *G03G 15/235* (2013.01); *G03G 15/6541* (2013.01); *G03G 15/6544* (2013.01); *G03G 15/6588* (2013.01); *G03G 15/6591* (2013.01); *G03G 15/2042* (2013.01); *G03G 15/2046* (2013.01); *G03G 15/6511* (2013.01)

(58) Field of Classification Search
CPC ..... G03G 15/205; G03G 15/2039; G03G 15/2042; G03G 15/2046; G03G 15/235; G03G 15/6511; G03G 15/6541; G03G 15/6544; G03G 15/6588; G03G 15/6591
See application file for complete search history.

(56) References Cited

U.S. PATENT DOCUMENTS

2003/0091790 A1* 5/2003 Fujisawa ..... G03G 8/00 428/141
2009/0096703 A1* 4/2009 Chase ..... B32B 27/10 343/841
2017/0274620 A1* 9/2017 Nishino ..... B32B 7/06
2019/0218437 A1* 7/2019 Hu ..... C09J 5/00

FOREIGN PATENT DOCUMENTS

JP H09-197865 A 7/1997

* cited by examiner

*Primary Examiner* — Joseph S Wong
(74) *Attorney, Agent, or Firm* — Foley & Lardner LLP

(57) ABSTRACT

A printing apparatus includes a tray on which a first medium, a decoration to decorate the first medium, and a second medium placed on the first medium and the second decoration are placed, a heating section, an image forming device and a processor, the first medium or the second medium containing an adhesive. A toner image is formed on at least one of the first medium or the second medium. The processor is configured to heat the heating section to a first temperature to bond to each other the first medium, the decoration and the second medium in such a manner that the decoration is sandwiched between the first medium and the second medium, and to heat the heating section to a second temperature lower than the first temperature to fix the toner image on at least one of the first medium or the second medium bonded to each other.

20 Claims, 6 Drawing Sheets

PRINTING APPARATUS AND PRINTING METHOD

FIELD

Embodiments described herein relate generally to a printing apparatus and a printing method.

BACKGROUND

A printing apparatus prints an image on a medium such as a postcard to which a decoration such as a pressed flower adheres, for example. A user prints an image on a postcard using the printing apparatus after bonding a pressed flower to the postcard in advance with an iron or the like.

Conventionally, there is a problem that the printing apparatus cannot print an image on the medium while bonding the decoration to the medium.

In order to solve the above problem, there is provided a printing apparatus and a printing method capable of printing an image on the medium while bonding the decoration to the medium.

DETAILED DESCRIPTION

In accordance with at least one embodiment, a printing apparatus comprises a tray on which a first medium containing an adhesive, a decoration placed on the first medium to decorate the first medium, and a second medium placed on the first medium and the decoration are placed; a heating section; an image forming device configured to form a toner image on at least one of the first medium and the second medium; and a processor configured to heat the heating section to a first temperature to bond the first medium, the decoration and the second medium in such a manner that the decoration is sandwiched between the first medium and the second medium, and to heat the heating section to a second temperature lower than the first temperature to fix the toner image on at least one of the first medium and the second medium bonded to each other.

Hereinafter, an embodiment is described with reference to the accompanying drawings.

The multifunction peripheral (printing apparatus) according to the embodiment bonds a decoration such as a pressed flower to a predetermined medium. The multifunction peripheral heats an adhesive member contained in the medium. The multifunction peripheral bonds the medium and the decoration using the adhesive member whose adhesion increases when heated. The multifunction peripheral prints an image on the medium to which the decoration is bonded. The multifunction peripheral prints an image on the medium by transferring a toner image onto the medium and heating it.

Figure 1:
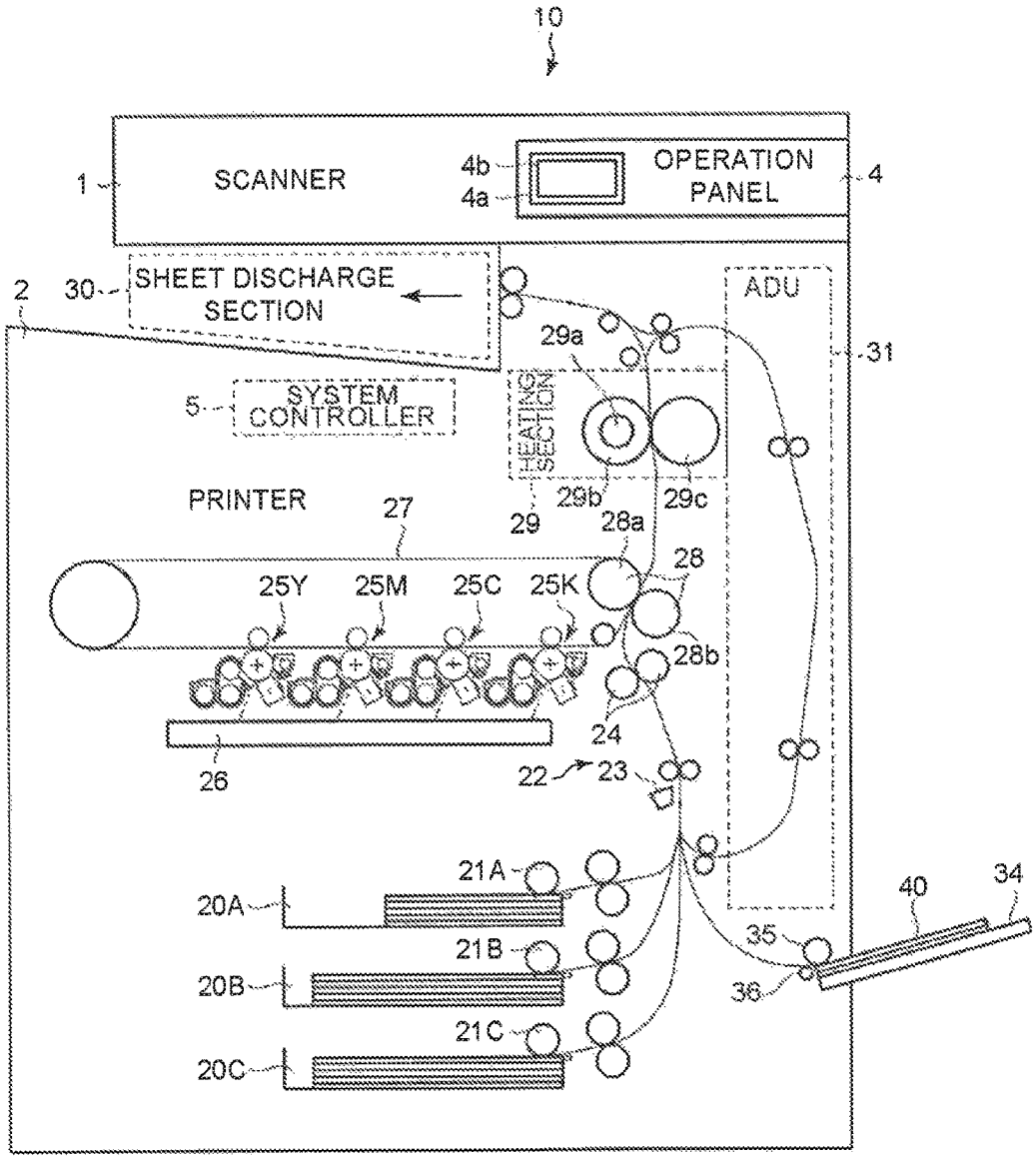
FIG. 1 is a cross-sectional view illustrating an example of an arrangement of a multifunction peripheral according to at least one embodiment.

FIG. 1 is a cross-sectional view schematically illustrating an example of an arrangement of a multifunction peripheral 10 according to at least one embodiment. As shown in FIG. 1, the multifunction peripheral 10 comprises a scanner 1, a printer 2, an operation panel 4 and a system controller 5.

The scanner 1 reads an image on a document to convert it to image data. The scanner 1 is, for example, a CCD (Charge Coupled Device) line sensor for converting an image on a reading surface of the document to image data. The scanner 1 may scan a document placed on a document table glass, or may read an image on a document conveyed by an ADF (Auto Document Feeder). The scanner 1 has a function of detecting a size of the document (document detection function). The scanner 1 is installed, for example, at the upper side of a main body of the multifunction peripheral 10. The scanner 1 is controlled by the system controller 5. The scanner 1 outputs the image data of the document to the system controller 5.

The printer 2 forms an image on a predetermined sheet (medium). The printer 2 has a color printing function of printing a color image on a normal sheet and a monochrome printing function of printing a monochrome image (for example, black) on the normal sheet. The printer 2 is, for example, an image forming apparatus of an electrophotographic system. The printer 2 forms a color image using toners of a plurality of colors (for example, three colors, i.e., yellow (Y), cyan (C) and magenta (M)). The printer 2 forms a monochrome image using monochrome (for example, black (K)) toner.

In the example of the configuration shown in FIG. 1, the printer 2 includes sheet feed cassettes 20 (20A, 20B and 20C) as sheet feed sections. The sheet feed cassette 20 is a sheet feed section which supplies the sheet. For example, each of the sheet feed cassettes 20A, 20B and 20C is provided in a state of being openable (detachable) at the lower side of the main body of the multifunction peripheral 10. The sheet feed cassettes 20A, 20B and 20C accommodate set types (for example, size or sheet quality) of sheets, respectively. The number of the sheet feed cassettes as sheet feed sections is not limited to three. For example, the number of the sheet feed cassettes may be one or two, or four or more.

The sheet feed cassettes 20A, 20B and 20C include sheet feed rollers 21A, 21B and 21C, respectively. The sheet feed rollers 21A, 21B and 21C pick up sheets one by one from the sheet feed cassettes 20A, 20B and 20C, respectively. The sheet feed rollers 21A, 21B and 21C supply the sheets taken out to a conveyance section 22 composed of a plurality of conveyance rollers.

The printer 2 has a manual feed tray 34 as the sheet feed section. The manual feed tray 34 feeds the sheet. For example, the manual feed tray 34 is formed on the side of the multifunction peripheral 10. The manual feed tray 34 has a structure that can be opened and closed, and the sheet can be set on the manual feed tray 34 when in an open state. The number of the manual feed trays 34 as the sheet feed sections may be two or more.

Here, the manual feed tray 34 stacks a medium 40 obtained by superimposing a first sheet including an adhesive sheet, a decoration and a second sheet to supply it. The medium 40 is described in detail later.

The manual feed tray 34 has a sheet feed roller 35. The sheet feed roller 35 picks up the sheets one by one from the manual feed tray 34. The sheet feed roller 35 feeds the sheet taken out to the conveyance section 22.

The manual feed tray 34 also has a separation roller 36. The separation roller 36 returns unnecessary sheets to the manual feed tray 34 when the sheet feed roller 35 picks up extra sheets when compared with the assumed number of sheets.

The sheet feed roller 35 and the separation roller 36 are described in detail later.

The conveyance section 22 conveys the sheet in the printer 2. The conveyance section 22 conveys the sheet fed by the sheet feed rollers 21A, 21B and 21C to a registration roller 24. The conveyance section 22 conveys the sheet fed by the sheet feed roller 35 to the registration roller 24. The registration roller 24 conveys the sheet to a transfer position at a timing of transferring an image from an intermediate transfer belt 27 onto the sheet.

A jam sensor 23 detects that the sheet conveyed by the conveyance section 22 is jammed. For example, the jam sensor 23 detects that a jammed sheet contacts. A plurality of jam sensors 23 may be provided on the path of the conveyance section 22.

Image forming sections 25 (25Y, 25M, 25C and 25K) (image forming devices), an exposure section 26, the intermediate transfer belt 27 and a transfer section 28 function as an image forming module for forming an image. The image forming sections 25 (25Y, 25M, 25C and 25K) form images to be transferred onto the sheet. In the example of the configuration shown in FIG. 1, the image forming section 25Y forms a yellow toner image. The image forming section 25M forms a magenta toner image. The image forming section 25C forms a cyan toner image. The image forming section 25K forms a black toner image. Each of the image forming sections 25 (25Y, 25M, 25C and 25K) superimposes the toner images of the respective colors on the intermediate transfer belt 27 to transfer them. As a result, a color toner image is formed on the intermediate transfer belt 27.

The exposure section 26 forms an electrostatic latent image on a photoconductive drum (image carrier) of each image forming section 25 (25Y, 25M, 25C or 25K) using laser beam. The exposure section 26 irradiates the photoconductive drum with the laser beam controlled according to the image data via an optical system such as a polygon mirror. The laser beam from the exposure section 26 forms the electrostatic latent image on the surface of each photoconductive drum. The exposure section 26 controls the laser beam in response to a control signal from the system controller 5. The electrostatic latent image formed on each photoconductive drum is an image developed with toner of each color. For example, the exposure section 26 controls the power of the laser beam in response to a control signal from the system controller 5. The exposure section 26 also controls the modulation amount of a pulse width for controlling the emission of the laser beam according to the control signal from the system controller 5.

Each of the image forming sections 25 (25Y, 25M, 25C and 25K) develops the electrostatic latent image formed on the respective photoconductive drums with the toners of respective colors. Each of the image forming sections 25 (25Y, 25M, 25C and 25K) forms a toner image as a visible image on the photoconductive drum. The intermediate transfer belt 27 is an intermediate transfer body. Each of the image forming sections 25 (25Y, 25M, 25C and 25K) transfers (primary transfer) the toner image formed on the photoconductive drum onto the intermediate transfer belt 27. Each of the image forming sections 25 (25Y, 25M, 25C and 25K) applies a transfer bias to the toner image at the primary transfer position. Each of the image forming sections 25 (25Y, 25M, 25C and 25K) controls the transfer bias by the transfer current. The toner images on respective photoconductive drums are transferred onto the intermediate transfer belt 27 by the transfer bias at the respective primary transfer positions. The system controller 5 controls the transfer current that each image forming section uses for the primary transfer processing.

Each of the image forming sections 25Y, 25M, 25C and 25K has sensors such as a potential sensor and a density sensor. The potential sensor detects a surface potential of the photoconductive drum. In each of the image forming sections 25Y, 25M, 25C and 25K, an electrostatic charger charges the surface of the photoconductive drum before the photoconductive drum is exposed by the exposure section 26. The system controller 5 can change charging conditions by the electrostatic charger. The potential sensor detects the surface potential of the photoconductive drum whose surface is charged by the electrostatic charger. The density sensor detects the density of the toner image transferred onto the intermediate transfer belt 27. The density sensor may detect toner image formed on the photoconductive drum.

For example, when forming a monochrome image, the image forming section 25K transfers the toner image (visible image) developed with black (monochrome) toner onto the intermediate transfer belt 27 (primary transfer). As a result, the intermediate transfer belt 27 holds the toner image formed with the black (monochrome) toner.

When forming a color image, the image forming sections 25Y, 25M, 25C, and 25K form toner images (visible images) developed with toners of respective colors (yellow, magenta, cyan, and black) onto the intermediate transfer belt 27 (primary transfer). As a result, the intermediate transfer belt 27 holds a color toner image formed by superimposing the toner images of respective colors.

The transfer section 28 transfers the toner image on the intermediate transfer belt 27 onto the sheet at a secondary transfer position. The secondary transfer position is a position at which the toner image on the intermediate transfer belt 27 is transferred onto the sheet. The secondary transfer position is a position where a support roller 28*a* and a secondary transfer roller 28*b* face each other. The transfer section 28 applies a transfer bias controlled according to the transfer current at the secondary transfer position. The transfer section 28 transfers the toner image on the intermediate transfer belt 27 onto the sheet with the transfer bias. The system controller 5 controls the transfer current used for the secondary transfer processing. For example, the system controller 5 may control a transfer current when transferring a decolorable toner image and a transfer current when transferring a normal toner image, respectively.

The heating section 29 heats the sheet conveyed by the conveyance section 22.

The heating section 29 heats the sheet. In the example shown in FIG. 1, the heating section 29 includes a heat roller 29*b* with a heater 29*a* built therein, and a pressure roller 29*c* contacting with a heating belt heated by the heat roller 29*b* in a pressurized state. The temperature of the heater 29*a* is controllable. For example, the heater 29*a* may be a heater lamp such as a halogen lamp. The heater 29*a* may be an induction heating system (IH system) heater. The heater 29*a* may be composed of a plurality of heaters.

For example, when performing an adhesion processing on the medium 40, the system controller 5 controls the heating section 29 to a predetermined adhesion temperature. The heating section 29 controlled to the fixing temperature heats the medium 40 to the adhesion temperature while pressurizing the medium 40. The adhesion temperature is a temperature at which the adhesive sheet functions as an adhesive. Therefore, with the heating section 29, the adhesive sheet of the medium 40 functions as the adhesive. For example, the adhesion temperature is about 100 to 120 degrees centigrade.

Further, in the case of performing a fixing processing for fixing a toner image on the sheet, the system controller 5 controls the heating section 29 to a predetermined fixing temperature. The heating section 29 controlled to the fixing temperature heats a normal sheet onto which the toner image is transferred by the transfer section 28 to the fixing temperature while pressurizing the normal sheet. Therefore, the heating section 29 fixes the toner image on the normal sheet. For example, the fixing temperature is lower than the adhesion temperature. For example, the fixing temperature is about 80 to 90 degrees centigrade.

The operation panel 4 is a user interface. The operation panel 4 has an operation section 4*b* and a display section 4*a*.

Various operation instructions are input by a user through the operation section 4*b*. The operation section 4*b* outputs data relating to the operation instruction input by the user to the system controller 5. The operation section 4*b* is, for example, a keyboard, a numeric pad, a touch panel, and the like. Here, it is assumed that the operation section 4*b* is a touch panel.

The display section 4*a* displays various information under the control of the system controller 5. The display section 4*a* is, for example, a liquid crystal monitor or the like. Here, the display section 4*a* is formed integrally with the operation section 4*b* which is the touch panel.

The operation panel 4 receives input of an operation mode, setting information or the like. For example, the operation panel 4 receives an operation of designating a specific sheet feed cassette (sheet feed section) as a dedicated cassette for black (monochrome) from the user. Here, the dedicated cassette for black (monochrome) is a cassette (sheet feed section) which is used for the monochrome (black) printing and prevented from being used for the color printing.

Furthermore, the operation panel 4 receives a setting of an operation mode (adhesion mode) in which the decoration is bonded to the medium 40. For example, the operation panel 4 detects a touch on a predetermined icon to receive the setting of the operation mode.

The operation panel 4 may further include a physical button. The operation panel 4 outputs information input through the button to the system controller 5.

A sheet discharge section 30 stacks sheets on which the images are formed or sheets on which images are decolored. In the example shown in FIG. 1, the sheet discharge section 30 is formed between the printer 2 and the scanner 1. The sheet discharge section 30 may be formed at any position.

An ADU 31 (Automatic Duplex Unit) switches the sheet back. The ADU 31 reverses the sheet conveyed by the conveyance section 22. For example, the ADU 31 conveys the sheet to the transfer section 28 after fetching the sheet passing through the heating section 29 and then reversing the sheet.

Next, an example of a configuration of a control system of the multifunction peripheral 10 is described.

Figure 2:
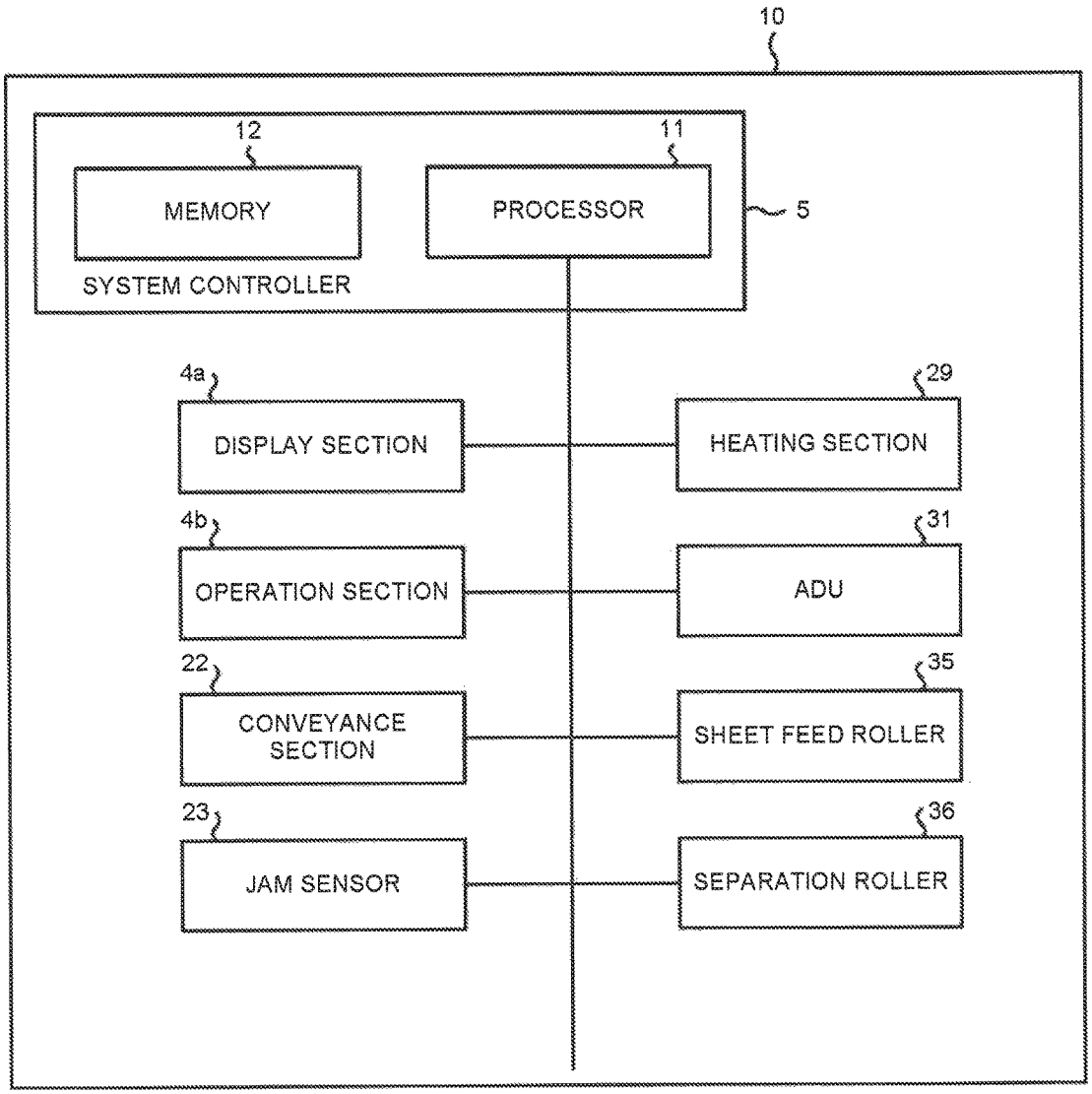
FIG. 2 is a block diagram illustrating an example of an arrangement of the multifunction peripheral according to at least one embodiment.

FIG. 2 shows an example of a configuration of the control system of the multifunction peripheral 10. As shown in FIG. 2, the multifunction peripheral 10 includes the system controller 5, the display section 4*a*, the operation section 4*b*, the conveyance section 22, the jam sensor 23, the heating section 29, the ADU 31, the sheet feed roller 35, and the separation roller 36. The system controller 5 and each section described above are connected to each other via a data bus or the like.

The system controller 5 includes a processor 11, a memory 12, and the like.

The processor 11 controls the whole operation of the system controller 5. In other words, the processor 11 controls the whole operation of the multifunction peripheral 10. The processor 11 may include an internal cache and various interfaces. The processor 11 realizes various processing by executing programs stored in advance in the internal cache or the memory 12.

A part of the various functions realized by executing the programs by the processor 11 may be realized by a hardware circuit. In this case, the processor 11 controls functions realized by the hardware circuit.

The memory 12 stores various data. For example, the memory 12 functions as a ROM (Read Only Memory), a RAM (Random Access Memory), and a NVM (Non-Volatile Memory).

For example, the memory 12 stores control programs, control data, and the like. The control program and the control data are incorporated in advance according to the specification of the multifunction peripheral 10. For example, the control program is a program that supports functions realized by the multifunction peripheral 10.

Furthermore, the memory 12 temporarily stores data being processed by the processor 11. The memory 12 may store data necessary for executing an application program, an execution result of the application program, and the like.

The display section 4*a*, the operation section 4*b*, the conveyance section 22, the jam sensor 23, the heating section 29, the ADU 31, the sheet feed roller 35 and the separation roller 36 are as described above.

Figure 3:
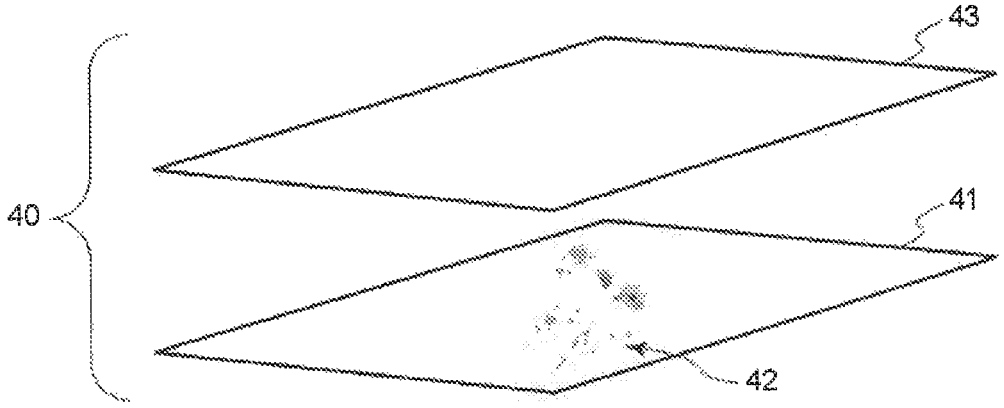
FIG. 3 is a diagram illustrating an example of an arrangement of a medium according to at least one embodiment.
Figure 4:
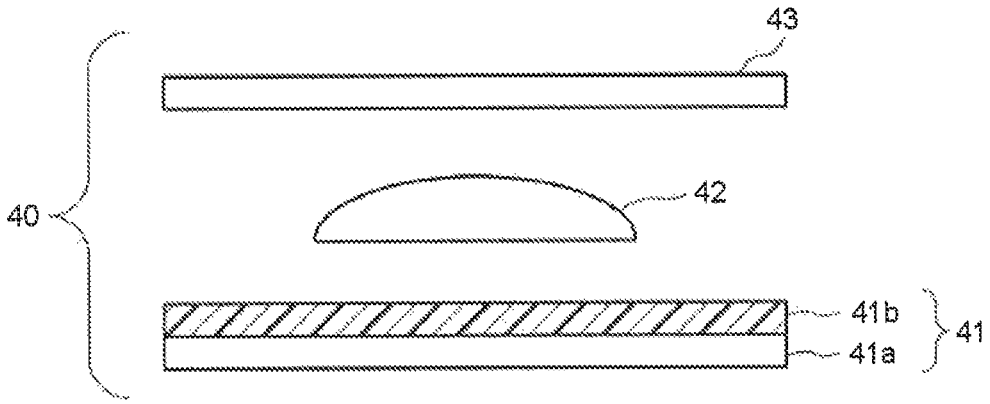
FIG. 4 is a diagram illustrating an example of an arrangement of the medium according to at least one embodiment.

Next, the medium 40 is described. FIG. 3 and FIG. 4 are diagrams illustrating examples of the configuration of the medium 40. As shown in FIG. 3 and FIG. 4, the medium 40 is composed of a first sheet 41 (a first medium), a decoration 42, and a second sheet 43 (a second medium).

The first sheet 41 is arranged at the bottom. The decoration 42 is arranged at a predetermined position on the first sheet 41. The second sheet 43 is arranged to cover the first sheet 41 and the decoration 42. In other words, on the manual feed tray 34, the first sheet 41, the decoration 42, and the second sheet 43 are stacked in order from the bottom.

The first sheet 41 is formed to have a predetermined size and shape. Here, the first sheet 41 is formed into a rectangular shape. For example, the first sheet 41 is formed in a postcard shape.

As shown in FIG. 4, the first sheet 41 is composed of a mount 41*a*, an adhesive sheet 41*b*, and the like. The mount 41*a* is formed at the bottom. The adhesive sheet 41*b* is formed on the mount 41*a*. In other words, the adhesive sheet 41*b* is in contact with the first sheet 41 and the decoration 42.

The mount 41*a* is formed to have a predetermined size and shape. Here, the mount 41*a* is formed in a rectangular shape.

The mount 41*a* may be an opaque normal sheet.

The mount 41*a* may be a transparent sheet. For example, the mount 41*a* may be a paraffin sheet or the like.

The adhesive sheet 41*b* is formed on the mount 41*a*. The adhesive sheet 41*b* is formed to have the same size and shape as the mount 41*a* and is formed to cover the upper surface of the mount 41*a*.

The adhesive sheet 41*b* is formed by a hot melt adhesive (adhesive member) such as a predetermined resin. In other words, when the adhesive sheet 41*b* is heated to a temperature equal to or higher than the predetermined temperature (adhesion temperature), the adhesive sheet 41*b* has a property of increasing adhesion thereof and functioning as the adhesive. The adhesive sheet 41*b* bonds the decoration 42 to the mount 41*a*. Further, the adhesive sheet 41*b* bonds the mount 41*a* to the second sheet 43.

The decoration 42 decorates the medium 40. The decoration 42 is formed into a sheet shape. For example, the decoration 42 is a pressed flower, origami, decorative sheet or metal foil. The decoration 42 is not limited to having a specific configuration.

The second sheet 43 is formed to have the same size and shape as the first sheet 41. The second sheet 43 may be a sheet having transparency through which the visible light penetrates or a sheet made of a material with which the decoration can be recognized through the second sheet 43. For example, the second sheet 43 is a predetermined thin sheet or the like. The adhesive sheet 41*b* may be provided on the side of the second sheet 43 instead of the mount 41*a*.

Next, the sheet feed roller 35 and the separation roller 36 are described.

Figure 5:
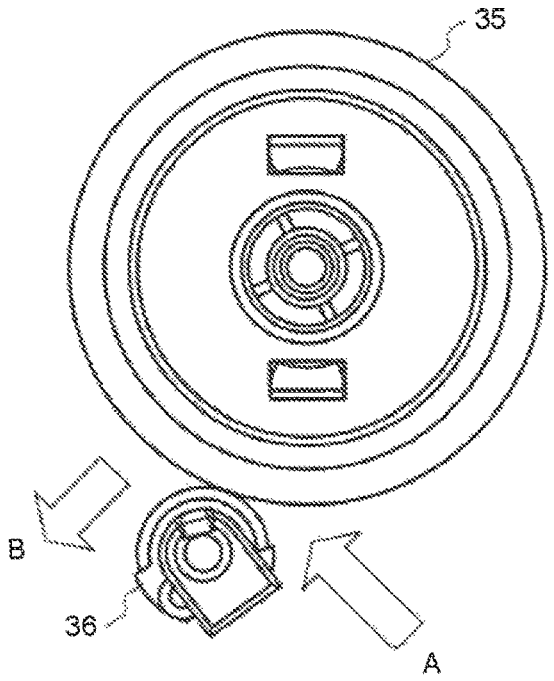
FIG. 5 is a diagram illustrating an example of arrangements of a separation roller and a sheet feed roller according to at least one embodiment.

FIG. 5 is a diagram illustrating an example of configurations of the sheet feed roller 35 and the separation roller 36. As shown in FIG. 5, the sheet feed roller 35 and the separation roller 36 are formed to contact with each other.

The sheet feed roller 35 feeds a sheet (or medium 40) contacting with the sheet feed roller 35. The sheet feed roller 35 supplies the medium 40 set on the manual feed tray 34 to the conveyance section 22. The sheet feed roller 35 is formed around a base of the manual feed tray 34. The sheet feed roller 35 is formed at a position in contact with the medium 40 set on the manual feed tray 34.

The sheet feed roller 35 rotates in a predetermined direction by a motor or the like. The sheet feed roller 35 conveys the sheet by a rotation operation. The sheet feed roller 35 feeds the sheet from the manual feed tray 34 to a space between the sheet feed roller 35 and the separation roller 36. In other words, the sheet feed roller 35 conveys the sheet in an A direction.

The separation roller 36 separates the sheet fed by the sheet feed roller 35 from other sheets. For example, the separation roller 36 separates a sheet stuck to the sheet fed by the sheet feed roller 35. The separation roller 36 rotates in the A direction by the rotation of the sheet feed roller 35 while receiving a predetermined resisting force. In other words, the separation roller 36 rotates in the A direction, and it rotates more slowly than the sheet feed roller 35 at a contact point. The separation roller 36 may rotate in a direction opposite to the A direction.

The separation roller 36 is separated from the sheet feed roller 35 by a predetermined distance based on a signal from the processor 11. In the example shown in FIG. 5, the separation roller 36 moves in a B direction. For example, the separation roller 36 is connected to a drive section such as a motor to move in the B direction by a driving force from the drive section.

The separation roller 36 is separated from the sheet feed roller 35 so that a width through which the medium 40 can pass is formed. Specifically, the processor 11 moves the separation roller 36 to a position where the first sheet 41 and the second sheet 43 of the medium 40 are not separated from each other. For example, the separation roller 36 is separated from the sheet feed roller 35 by a total thickness of the two sheets.

Figure 6:
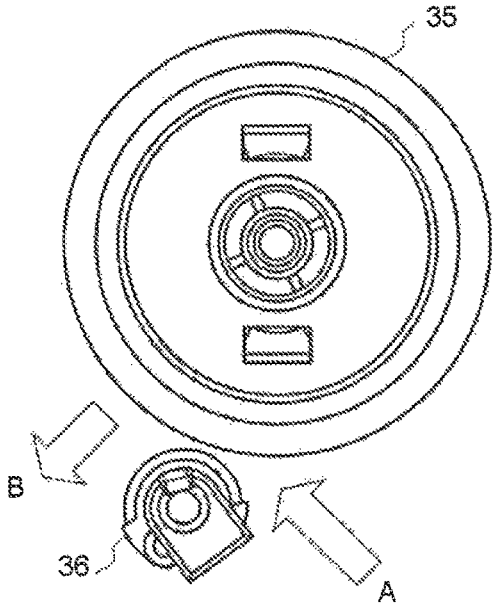
FIG. 6 is a diagram illustrating an example of arrangements of the separation roller and the sheet feed roller according to at least one embodiment.

FIG. 6 shows an example in which the separation roller 36 is separated from the sheet feed roller 35. As shown in FIG. 6, a width through which the medium 40 can pass is formed between the separation roller 36 and the sheet feed roller 35.

Next, an example of an operation by the processor 11 is described. The operation by the processor 11 is realized by executing a program stored in the memory 12 by the processor 11.

First, the processor 11 sets the adhesion mode.

For example, the processor 11 receives an operation of shifting to the adhesion mode through the operation section 4*b*. Upon receiving the operation, the processor 11 sets the adhesion mode.

If the adhesion mode is set, the processor 11 moves the separation roller 36 away from the sheet feed roller 35 by a predetermined distance. In other words, the processor 11 separates the separation roller 36 from the sheet feed roller 35 so that the width through which the medium 40 can pass is formed between the separation roller 36 and the sheet feed roller 35.

Here, it is assumed that the user sets the medium 40 on the manual feed tray 34.

The processor 11 picks up the medium 40 from the manual feed tray 34 using the sheet feed roller 35 to supply it to the conveyance section 22. Since the separation roller 36 is separated from the sheet feed roller 35, the first sheet 41 and the second sheet 43 are supplied to the conveyance section 22 without being separated from each other.

If the medium 40 is supplied to the conveyance section 22, the processor 11 conveys the medium 40 to the heating section 29 using the conveyance section 22. If the medium 40 is conveyed to the heating section 29, the processor 11 uses the heating section 29 to heat the medium 40 to the adhesion temperature. For example, the processor 11 heats the heating section 29 or the heat roller 29*b* to a first temperature by energizing the heater 29*a* which is a heat source. As a result, the processor 11 bonds the second sheet 43 to the decoration 42 and the first sheet 41. The temperature of the heating section 29 can be controlled by detecting the surface temperature of the heat roller 29*b* with a thermistor (not shown) and controlling the energization of the heater 29*a* so as to set the surface temperature of the heat roller 29*b* to the first temperature.

Figure 7:
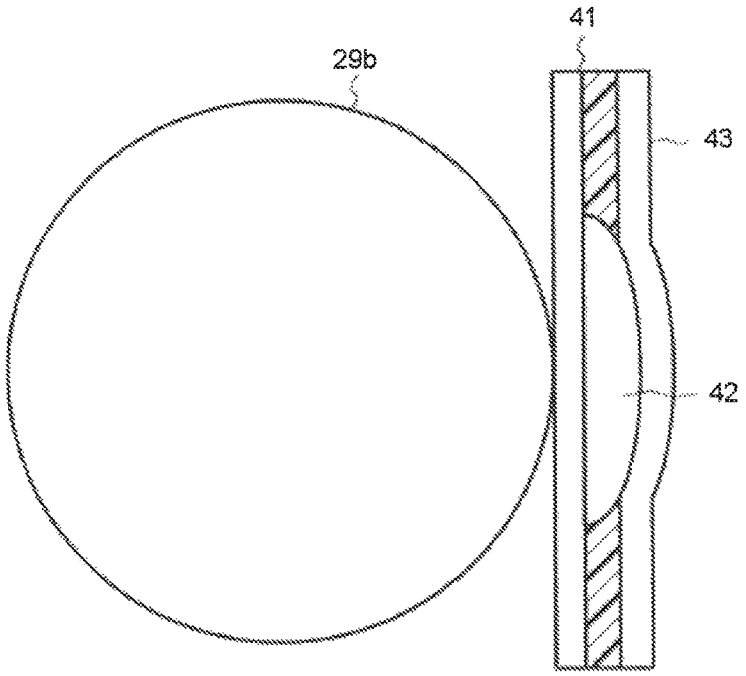
FIG. 7 is a diagram illustrating an example of an operation by the multifunction peripheral according to at least one embodiment.

FIG. 7 is a diagram illustrating an example of an operation in which the heating section 29 heats the medium 40. As shown in FIG. 7, the heat roller 29*b* of the heating section 29 contacts with the medium 40. The medium 40 is formed by stacking the first sheet 41, the decoration 42 and the second sheet 43 in order on the manual feed tray 34. Therefore, the heat roller 29*b* contacts with the first sheet 41 to heat the first sheet 41 side of the medium 40. As a result, the heat roller 29*b* heats the adhesive sheet 41*b* of the first sheet 41.

When the medium 40 is heated to the adhesion temperature, the processor 11 switches the medium 40 back using the ADU 31. For example, the processor 11 temporarily conveys the medium 40 from the heating section 29 to the sheet discharge section 30 side. If the medium 40 is conveyed to the sheet discharge section 30 side, the processor 11 conveys the medium 40 to the ADU 31. If the medium 40 is conveyed to the ADU 31, the processor 11 conveys the medium 40 to a position in the front of the registration roller 24 by using the ADU 31.

If the medium 40 is switched back, the processor 11 transfers the toner image onto the second sheet 43 side of the medium 40 using the transfer section 28.

For example, the processor 11 previously acquires the image data for forming a toner image. The processor 11 acquires the image data from a predetermined document using the scanner 1. The processor 11 may also acquire the image data from an external memory or an external device.

If the image data is acquired, the processor 11 primarily transfers the toner image based on the image data onto the intermediate transfer belt 27 using the image forming section 25. For example, the image forming sections 25Y, 25M, 25C and 25K primarily transfer the toner images onto the intermediate transfer belt 27 in a superimposed manner.

If the toner image is primarily transferred onto the intermediate transfer belt 27, the processor 11 secondarily transfers the toner image from the intermediate transfer belt 27 onto the medium 40 using the transfer section 28. For example, the processor 11 conveys the medium 40 to the transfer section 28 in accordance with a timing at which the toner image on the intermediate transfer belt 27 reaches the transfer section 28, and secondarily transfers the toner image onto the medium 40.

If the toner image is transferred onto the medium 40, the processor 11 conveys the medium 40 to the heating section 29 using the conveyance section 22. After the medium 40 is conveyed to the heating section 29, the processor 11 heats the medium 40 to a fixing temperature using the heating section 29. For example, the processor 11 controls the energization of the heater 29*a* to heat the surface temperature of the heating section 29 or the heat roller 29*b* to a second temperature lower than the first temperature, thereby heating the medium 40 to the fixing temperature. As a result, the processor 11 fixes the toner image on the second sheet 43 of the medium 40.

Figure 8:
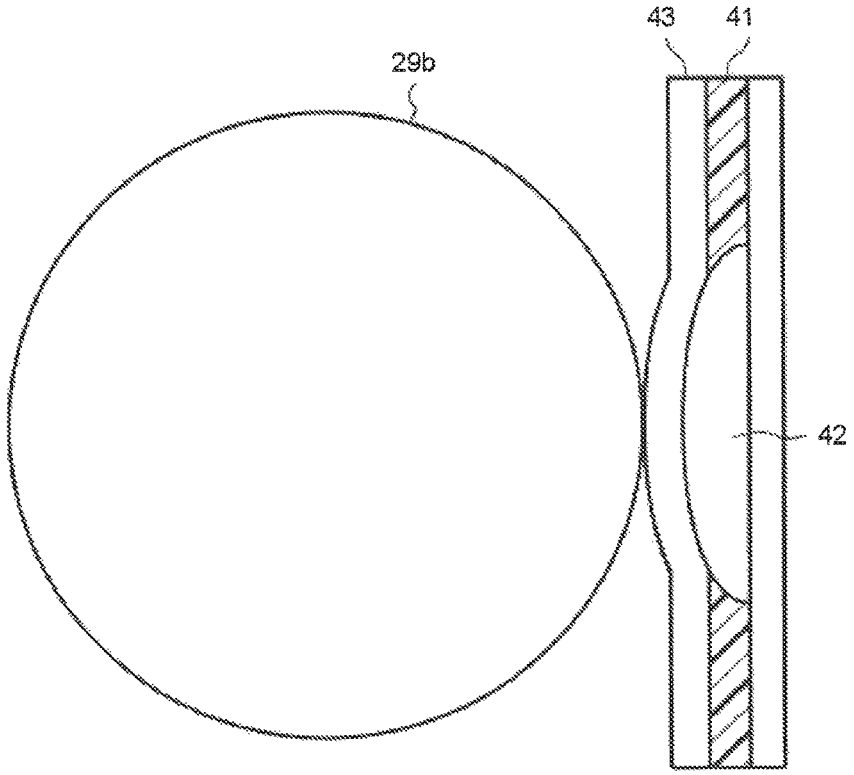
FIG. 8 is a diagram illustrating an example of an operation by the multifunction peripheral according to at least one embodiment.

FIG. 8 is a diagram illustrating an example of an operation in which the heating section 29 heats the medium 40. As shown in FIG. 8, the heat roller 29*b* of the heating section 29 contacts with the medium 40. The medium 40 is switched back by the ADU 31. Therefore, the heat roller 29*b* contacts with the second sheet 43 to heat the second sheet 43 side of the medium 40. As a result, the heat roller 29*b* heats the toner image formed on the second sheet 43.

If the medium 40 is heated to the fixing temperature, the processor 11 discharges the medium 40 to the sheet discharge section 30 using the conveyance section 22. If the medium 40 is discharged to the sheet discharge section 30, the processor 11 terminates the operation. If there is a plurality of media 40, the processor 11 may continuously perform the above-described operation.

The processor 11 may transfer the toner image onto the first sheet 41 of the medium 40 to fix the toner image. For example, the processor 11 conveys the medium 40 to the transfer section 28 without switching the medium 40 back after the medium 40 is heated at the adhesion temperature. If the medium 40 is conveyed to the transfer section 28, the processor 11 secondarily transfers the toner image from the intermediate transfer belt 27 onto the first sheet 41 of the medium 40. If the toner image is secondarily transferred, the processor 11 heats the toner image using the heating section 29 to fix the toner image.

After the medium 40 is heated at the adhesion temperature, the processor 11 may transfer toner images onto both the first sheet 41 and the second sheet 43 to fix the toner images.

The mount 41*a* of the first sheet 41 may be made of vinyl, plastic, or the like. The material forming the mount 41*a* is not limited to a specific configuration.

The first sheet 41 may be formed by applying an adhesive member to the mount 41*a*. The first sheet 41 may be formed by applying an adhesive member to a part of the mount 41*a*. The second sheet 43 may cover a part of the first sheet 41.

The second sheet 43 may be made of vinyl, plastic, or the like. The material forming the second sheet 43 is not limited to a specific configuration.

The medium 40 may not include the second sheet 43.

The heating section 29 may be a heating section of a system in which the toner image is fixed on the medium with a film-like rotating body heated by the heater 29*a*.

Figure 9:
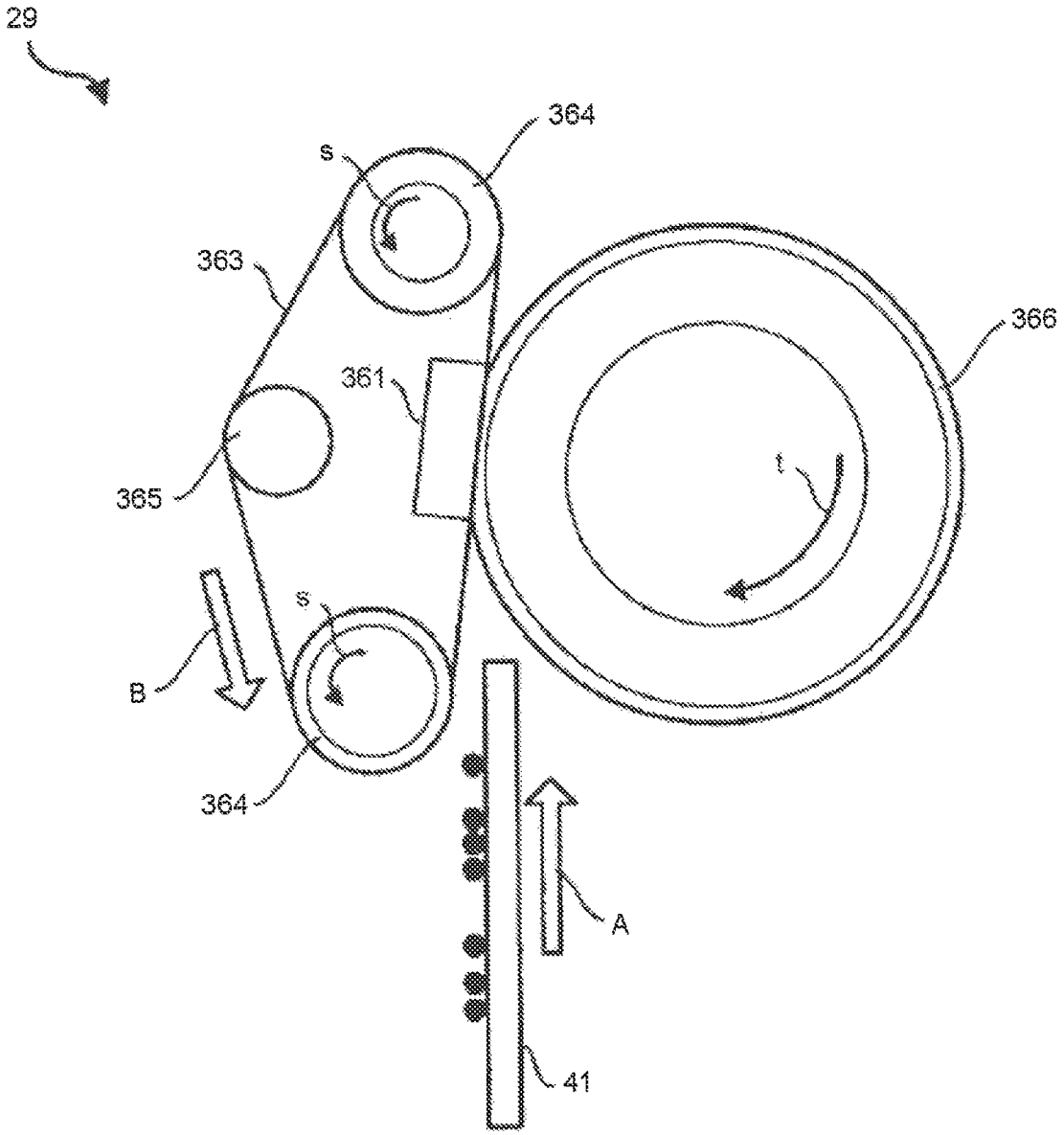
FIG. 9 is a diagram illustrating a modification of a heating section according to at least one embodiment.

Next, a modification of the heating section 29 is described. FIG. 9 is a diagram illustrating a modification of the heating section 29. As shown in FIG. 9, the heating section 29 includes a plate-like thermal head 361, an endless belt 363 on which an elastic layer is formed and which is suspended by a plurality of rollers and is made of a film-like member, a belt conveyance roller 364 for driving the endless belt 363, a tension roller 365 for applying a tension to the endless belt 363, and a press roller 366 with an elastic layer formed on a surface thereof.

The thermal head 361 contacts with the inner side of the endless belt 363 on the side of a heat generating portion thereof, and is pushed towards the direction of the press roller 366, thereby forming a fixing nip having a predetermined width between the thermal head 361 and the press roller 366. Since the thermal head 361 forms a nip region while heating the nip region, the responsiveness thereof at the time of energization is higher than that of the thermal head 361 of the heating system using a halogen lamp.

For example, the endless belt 363 (film-like rotating body) is formed by forming a silicone rubber layer with a thickness of 200 μm on the outer side of a polyimide which is SUS substrate having a thickness of 50 μm or a heat resistant resin having a thickness of 70 μm, and then coating the outermost periphery thereof with a surface protective layer such as PFA (Polyfluoroalkoxy). The press roller 366 is formed by, for example, forming a silicon sponge layer having a thickness of 5 mm on the surface of a steel bar having a diameter of 10 mm and then coating the outermost periphery thereof with a surface protective layer such as PFA.

On the thermal head 361, a glaze layer and a heat resistance layer are stacked on a ceramic substrate. A heat sink made of aluminum is bonded in order to prevent excess heat from escaping at the opposite side and prevent warping of the substrate as well. The heat resistance layer is made of a known material such as $TaSiO_2$, for example, and is divided into a predetermined length and quantity in a main scanning direction.

In the multifunction peripheral configured as described above, a medium composed of the first sheet including the adhesive sheet, the decoration, and the second sheet is heated from the first sheet side at the adhesion temperature. As a result, the multifunction peripheral can bond the decoration to the first sheet, and bond the second sheet to the first sheet as well.

The multifunction peripheral forms the toner image on the second sheet. The multifunction peripheral heats the toner image from the second sheet side at the fixing temperature. As a result, the multifunction peripheral can form an image by fixing the toner image on the second sheet.

The multifunction peripheral can prevent a hot offset from occurring in the toner for forming the toner image by heating the toner image at the fixing temperature after heating the medium at the adhesion temperature which is higher than the fixing temperature.

The multifunction peripheral can move the separation roller away from the sheet feed roller by a predetermined distance. As a result, the multifunction peripheral can feed the medium without separating the medium with the separation roller.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A printing apparatus, comprising:

a tray on which a first medium, a decoration placed on the first medium to decorate the first medium, and a second medium placed on the first medium and the decoration are placed, the first medium or the second medium containing an adhesive;

a heating section;

an image forming device configured to form a toner image on at least one of the first medium or the second medium; and a processor configured to heat the heating section to a first temperature to bond the first medium, the decoration and the second medium to each other in such a manner that the decoration is sandwiched between the first medium and the second medium, and to heat the heating section to a second temperature, lower than the first temperature, to fix the toner image on at least one of the first medium or the second medium bonded to each other.

2. The printing apparatus according to claim 1, further comprising:

an automatic duplex unit configured to switch back the first medium and the second medium bonded to each other, wherein the processor is configured to:

heat the heating section to the first temperature to heat the first medium side, to switch back the first medium and the second medium bonded to each other by using the automatic duplex unit, convey the first medium and the second medium bonded to each other and switched back to a position where the toner image formed by the image forming device is transferred, transfer the toner image formed by the image forming device onto the second medium side, and heat the heating section at the second temperature to heat the second medium side.

3. The printing apparatus according to claim 2, further comprising:

an intermediate transfer belt onto which the toner image formed by the image forming device is transferred; and a transfer roller configured to transfer the toner image from the intermediate transfer belt onto the second medium, wherein the processor is configured to:

convey the first medium and the second medium bonded to each other and switched back to the transfer roller, and transfer the toner image from the intermediate transfer belt onto the second medium using the transfer roller.

4. The printing apparatus according to claim 1, further comprising:

a sheet feed roller configured to feed a sheet in contact with the sheet feed roller from the tray; and a separation roller configured to separate a sheet fed by the sheet feed roller from other sheets, wherein the processor is configured to move the separation roller to a position where the first medium and the second medium fed by the sheet feed roller are not separated from each other when the sheet feed roller feeds the first medium, the decoration and the second medium.

5. The printing apparatus according to claim 4, wherein the processor is configured to separate the separation roller from the sheet feed roller by a predetermined distance when the sheet feed roller feeds the first medium, the decoration and the second medium.

6. The printing apparatus according to claim 1, wherein the first medium includes an adhesive sheet formed by the adhesive.

7. The printing apparatus according to claim 6, wherein the adhesive includes a resin.

8. The printing apparatus according to claim 1, wherein the second medium includes an adhesive sheet formed by the adhesive.

9. The printing apparatus according to claim 1, wherein the second medium has a transmittance such that visible light penetrates through the second medium.

10. The printing apparatus according to claim 1, wherein the decoration is formed into a sheet shape.

11. The printing apparatus according to claim 10, wherein the decoration includes a pressed flower.

12. The printing apparatus according to claim 1, wherein the heating section comprises a thermal head, and a film-like rotating body heated by the thermal head.

13. The printing apparatus according to claim 1, wherein the heating section comprises a lamp and a rotating body heated by the lamp.

14. The printing apparatus according to claim 1, wherein the heating section comprises a heater of an induction heating system, and a rotating body heated by the heater.

15. A printing method, comprising:

heating a heating section to a first temperature to bond to each other a first medium, a decoration placed on the first medium to decorate the first medium, and the second medium placed on the first medium and the decoration, such that the decoration is sandwiched between the first medium and the second medium, the first medium or the second medium containing an adhesive;

forming a toner image on at least one of the first medium or the second medium bonded to each other; and heating the heating section to a second temperature lower than the first temperature to fix the toner image on at least one of the first medium or the second medium bonded to each other.

16. The printing method according to claim 15, wherein the first medium includes an adhesive sheet formed by the adhesive.

17. The printing method according to claim 16, wherein the adhesive includes a resin.

18. The printing method according to claim 15, wherein the second medium includes an adhesive sheet formed by the adhesive.

19. The printing method according to claim 15, wherein the second medium has a transmittance such that visible light penetrates through the second medium.

20. The printing method according to claim 15, wherein the decoration is formed into a sheet shape.

* * * * *